United States Patent [19]

Roberts

[11] 4,193,961

[45] Mar. 18, 1980

[54] METHOD OF EXTRUDING POLYPROPYLENE YARN

[75] Inventor: John S. Roberts, Ellicott, Md.

[73] Assignee: Kling-Tecs, Inc., Mantoloking, N.J.

[21] Appl. No.: 893,371

[22] Filed: Apr. 4, 1978

[51] Int. Cl.[2] ..... D01D 5/22

[52] U.S. Cl. ..... 264/176 F; 264/234; 264/210.8

[58] Field of Search ..... 264/176 F, 234, 210 F

[56] References Cited

U.S. PATENT DOCUMENTS

| | | | |
|---|---|---|---|
| 3,361,859 | 1/1968 | Cenzato | 264/210 F |
| 3,426,754 | 2/1969 | Brevenbaum et al. | 264/210 F |
| 3,447,202 | 6/1969 | Kato | 264/210 F |
| 3,560,604 | 2/1971 | Papps | 264/168 |

FOREIGN PATENT DOCUMENTS

| | | | |
|---|---|---|---|
| 42-2937 | 2/1967 | Japan | 264/176 F |
| 44-915 | 1/1969 | Japan | 264/176 F |
| 47-46291 | 12/1972 | Japan | 264/168 |
| 50-39721 | 12/1975 | Japan | 264/210 F |
| 1018851 | 5/1964 | United Kingdom | 264/103 |

*Primary Examiner*—Jay H. Woo

*Attorney, Agent, or Firm*—Albert C. Nolte, Jr.; Edward B. Hunter

[57] ABSTRACT

A method of extruding multi-filament polypropylene yarn in which the polypropylene is extruded at a temperature below 425° F., such as in the range 415° F. to 350° F., particularly about 400° F., into a hot zone having a temperature sufficiently high to retard cooling of the extruded polypropylene yarn. The temperature of the hot zone can be within 60° F. of the temperature of extrusion. The yarn is then passed through a quenching zone across which air is blown to cool the yarn. The swell value of the polypropylene can be less than 3 and its melt flow may be greater than 30. The yarn is drawn down in the hot zone and the filaments may be drawn down to an undrawn denier of less than 40.

13 Claims, 5 Drawing Figures

METHOD OF EXTRUDING POLYPROPYLENE YARN

BACKGROUND OF THE INVENTION

Polypropylene yarns, particularly continuous filament textile face yarns, are usually produced with conventional 'down-the-stack' air quench extrusion apparatus. These are housed in a building several stories high with an extruder on an upper floor, air quench cabinets on the floor below, and inter-floor tubes extending down to a lower floor where the yarn is taken up onto packages. Cooled air is blown through the quench cabinets to solidify and cool the yarn.

One disadvantage that occurs is resonance in the formation of the filaments of the yarn. As the polypropylene melt is extruded through a capillary in a spinnerette, it swells out on the underside of the spinnerette and then the filament is drawn-down from such swelling. However, this drawing-down occurs non-uniformly and, in exaggeration, the filament forms like a string of sausage links: this is resonance. Subsequently, when the filaments are being fully drawn, this resonance tends to cause draw breaks in the filaments. The more pronounced the resonance, the greater the frequency of draw breaks.

Also, the point at which a filament completes its drawing-down, in the quench cabinet, to its undrawn denier varies. This can be seen as a rain drop effect when looking into the quench cabinet. This contributes to further non-uniformity.

The temperature at which the polypropylene melt is extruded is usually of the order of 500° F., although lower temperatures have been tried. It is known that, in general, as the temperature is lowered, the swell on the underside of the spinnerette gets greater with an increase in resonance, and even the occurance of spin breaks at or near the spinnerette face.

The problem of resonance and subsequent draw breaks gets more acute with finer denier per filament yarns, for example yarns having an undrawn denier per filament less than 30, say less than 10 denier per filament in the finally drawn yarn. Also, with finer denier yarns the problem of denier variation from filament to filament, as well as along the length of the filament, becomes more noticable.

SUMMARY OF THE INVENTION

The invention is based upon the realization that if the filaments are extruded into a relatively short hot zone, at or slightly below the temperature of extrusion, before they are contacted by the cooling air, then the extrusion temperature can be decreased without the usual increase in the volume of swell at the spinnerette face. It has been found that as the extrusion temperature decreases the resonance in the filaments decreases; and optimum point is reached around 400° F. When the temperature goes much lower than this optimum point, resonance starts increasing again and then spin breaks occur. The precise optimum point is believed to be influenced by the swell value of the polyproylene and its melt flow. It is theorized that as the temperature of the melt decreases, the melt becomes more Newtonian in its behavior; this is believed to be further helped as the swell value of the polypropylene is decreased, for example to below 2.5.

According to one aspect of the invention there is provided a method of extruding polypropylene yarn in which the polypropylene is extruded at a temperature below 425° F. into a hot zone having a temperature sufficiently high to retard cooling of the extruded polypropylene, and then the extruded polypropylene is passed through a quenching zone and cooled therein.

The extrusion temperature may be less than 420° F., such as in the range 415° F. to 350° F. or in the range 410° F. to 360° F.

The polypropylene may have a swell value of less than 3, preferably less than 2.5. The melt flow may be greater than 20, and is preferably greater than 30.

The temperature of said first zone may be less than 70° F. below the temperature of extrusion; it may be above 350° F. Preferably it is within 60° F. of the extrusion temperature.

Said first zone preferably contains air, or gas, in a quiescent state.

The yarn may have filaments which are drawn down in said first zone to a denier per filament of less than 40, for example less than 30.

In the quenching zone cooling air may be blown transversely over the yarn to cool it. The temperature of this cooling air may be less than 90° F. as it enters the quenching zone.

A specific embodiment of the invention will now be described in greater detail with reference to the accompanying drawings.

DESCRIPTION OF A SPECIFIC EMBODIMENT

Figure 1:
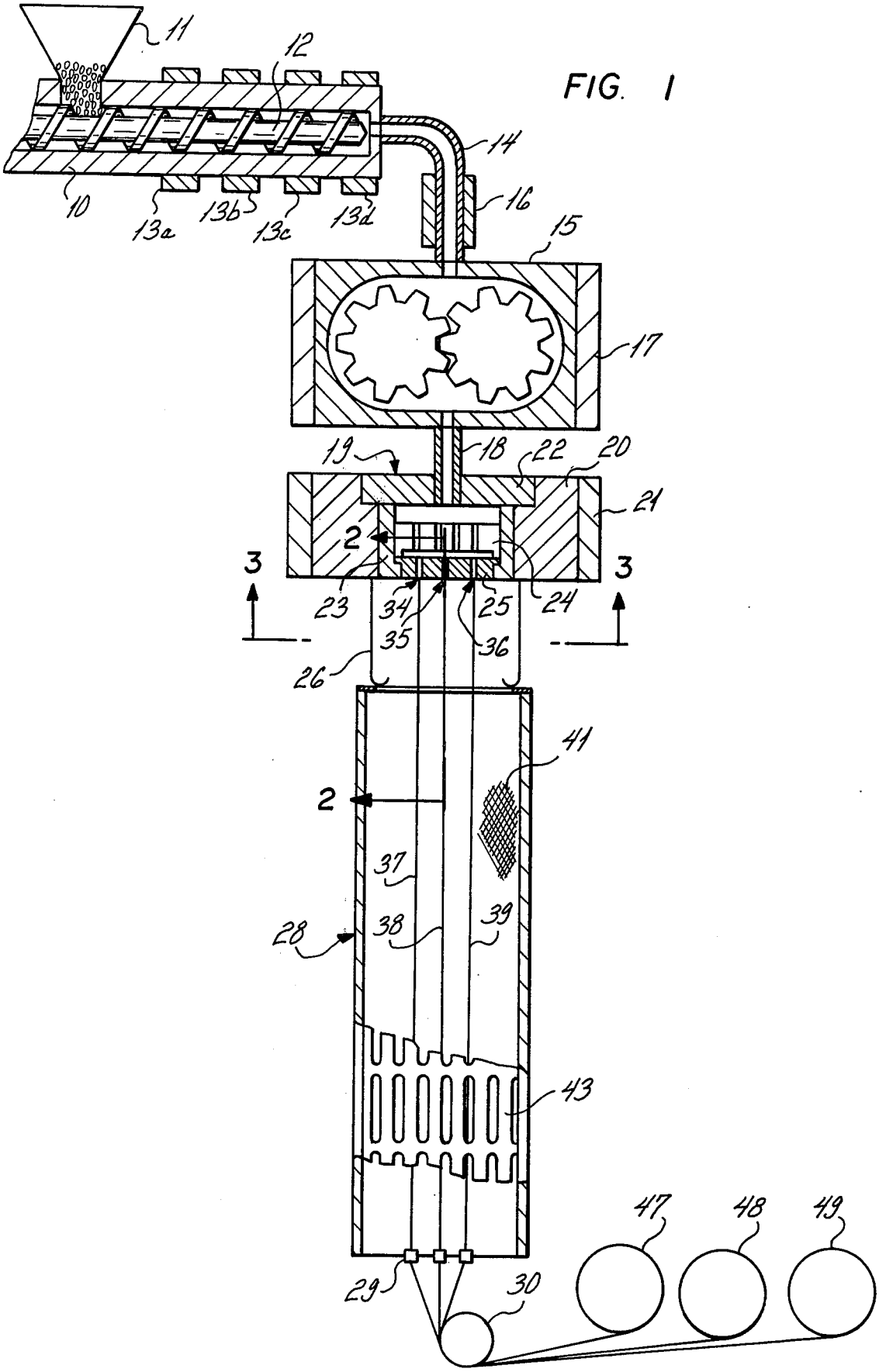
FIG. 1 is a schematic vertical section of an apparatus for carrying out the method of the invention.

In FIG. 1 an extruder 10 has an infeed hopper 11, a screw 12, and band heaters 13*a*, 13*b*, 13*c* and 13*d*. A transfer tube 14 connects the discharge end of the extruder 10 to a metering pump 15. The transfer tube 14 and the metering pump 15 are surrounded by band heaters 16 and 17, respectively. The discharge side of the metering pump 15 is conneected by a tube 18 to a spin pack 19 mounted in a spin block 20 which is surrounded by a band heater 21. The spin pack 19 has a cover plate 22, a body 23, a breaker plate 24, and a spinnerette 25. For simplicity, the usual heat insulation that covers the band heaters and other parts of the apparatus is not shown. A shroud 26 is attached by bolts 27 (see FIG. 2) to the underside of the spin block 20. Below the shroud 26 is mounted an air quench cabinet 28 at the bottom of which are finish applying guides 29. Just below the guides 29 is a denier control roll 30.

Figure 3:
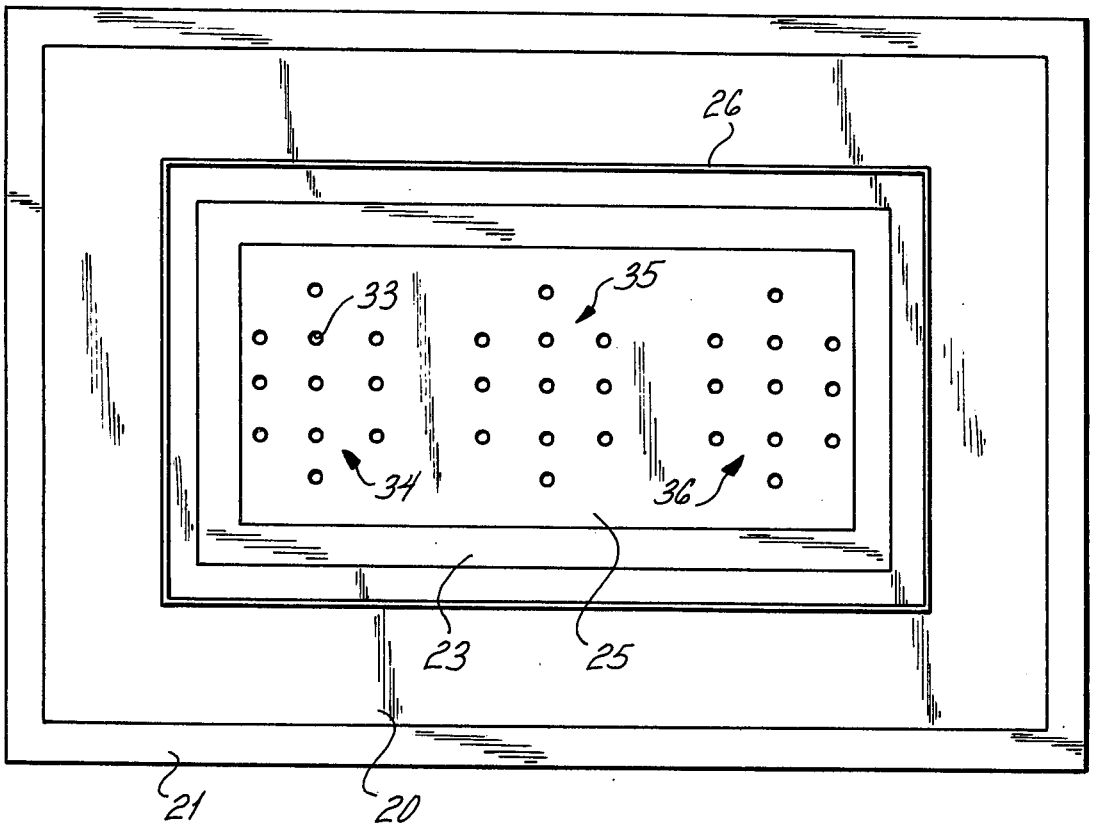
FIG. 3 is a diagrammatic sectional view on the line 3—3 of FIG. 1 but on the same scale as FIG. 2.

The shroud 26 defines a rectangle in horizontal section, see FIG. 3. At its upper end is a flange 31 through which the bolts 27 pass. At the lower end of the shroud 26 is an inwardly directed collecting trough 32.

The spinnerette 25 has capillaries 33 arranged in three groups 34, 35, and 36, respectively, to produce three multi-filament yarns 37, 38, and 39, respectively. To produce yarns having various filament counts, different spinnerettes can be used having a different number of capillaries.

The quench cabinet 28 has a top cover 40 which fits closely around the outside of the trough 32. One wall of the quench cabinet 28 is formed of wire mesh 41 supported in a frame 42. The opposite wall is formed of slotted sheet metal 43 supported in a frame 44. A cooling air plenum 45 registers with the wire mesh 41. In cross-section the quench cabinet is rectangular, similar to the shroud 26 and the face of the spinnerette 25 with the groups of capillaries 34, 35 and 36 spaced apart in a direction parallel to the longer sides of these rectangles.

Figure 2:
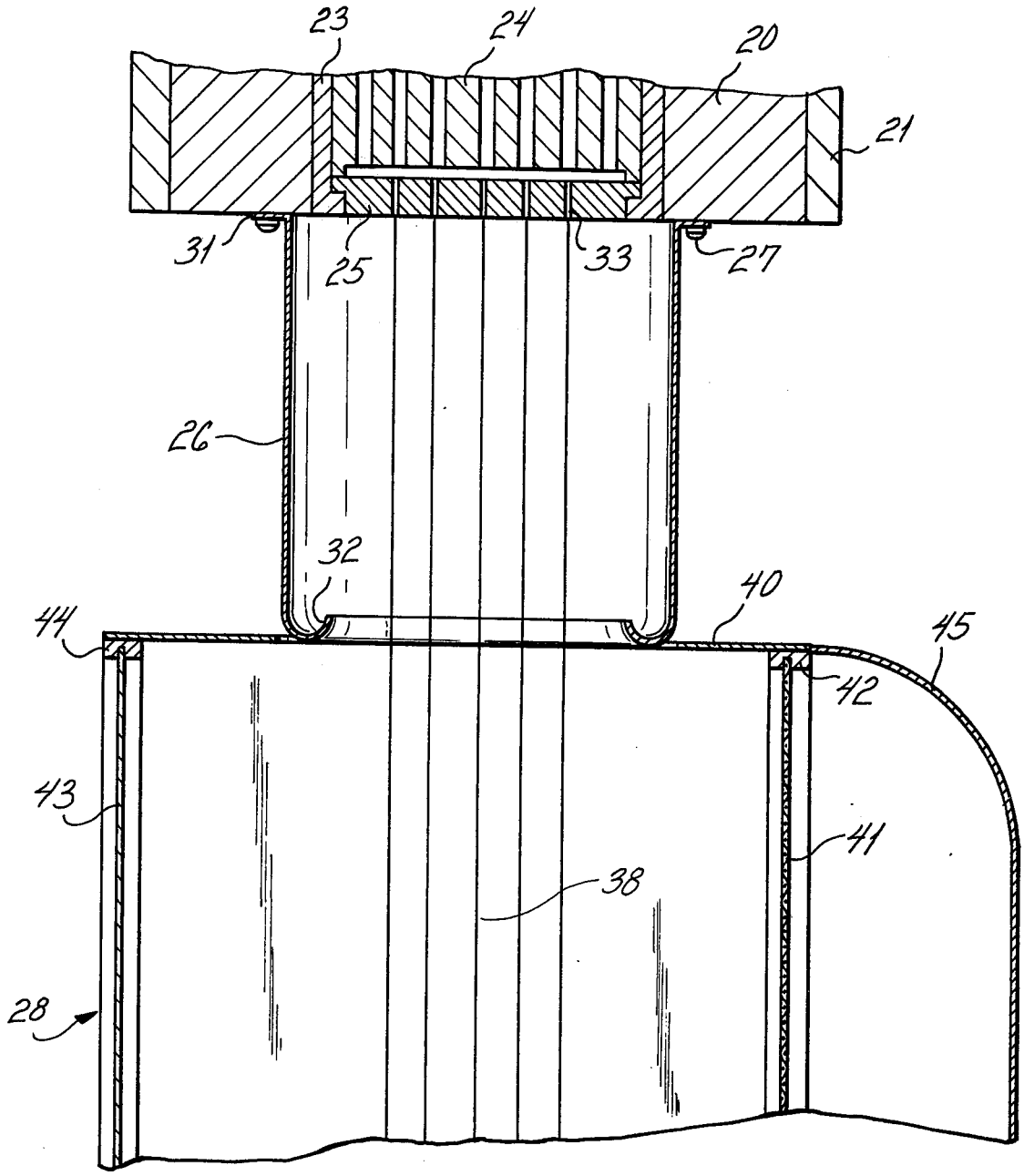
FIG. 2 is a diagrammatic section, on a larger scale, on the line 2—2 of FIG. 1.

The shroud 26 is relatively short and fits closely around the groups 34, 35 and 36 of capillaries but with sufficient clearance so that the yarns 37, 38 and 39, if they sway, do not come in contact with the inner edge of the trough 32. As seen in FIG. 3, the longer side of the shroud 26 is 12 inches and the shorter side 7 inches; the length of the face of the spinnerette 25 is 8 inches and the width 4 inches. The height of the shroud 26, as seen in FIG. 2, is 9 inches.

With the method according to the invention, pellets of polypropylene resin and pellets of color concentrate are fed via the hopper 11 into the extruder 10. The polypropylene has a melt flow of 30 and has a narrow molecular weight distribution with a die swell or swell value below 2, in this instance 1.9. The resin and color are melted and heated by the extruder heaters to a temperature of 400° F. and mixed by the screw 12. The heaters 13*a*, 13*b*, 13*c* and 13*d* are set to control their zones at 300° F., 350° F., 375° F. and 400° F., respectively. The downstream heaters 16, 17, 21 are set to control their zones at 400° F. The melt is fed by the screw 12 through the transfer tube 14 to the metering pump 15 which delivers a metered stream of melt through the tube 18 to the spin pack 19. Inside the spin pack this metered stream is hydraulically split and extruded downwards through the capillaries 33 into the multitude of filaments forming the three spaced apart yarns 37, 38, and 39. The number of capillaries in the spinnerette is chosen to determine the number of filaments in each yarn, in this instance 70 filaments. These yarns pass through the shroud 26, which defines a hot zone, and are then cooled as they pass through the quench cabinet 28. The cooling of the yarns is effected by blowing air transversely across them, the air from the plenum 45 entering the quench cabinet through the wire mesh 41 and being exhausted to atmosphere through the slots in the sheet metal 43. The cooled yarns then pass through the guides 29 which apply spin finish to them before they are brought together around the denier control roll 30, after which the three yarns are separated and wound onto separate packages 47, 48 and 49. The denier control roll pulls the yarns down from the capillaries 33 at a controlled rate, in this instance 600 meters per minute, to determine their undrawn denier, in this instance 900 denier.

The air inside the shroud 26 is trapped there and remains quiescent. This air is heated by the metal above it, namely the face of the spinnerette 25, the lower end of the pack body 23 and part of the spin block 20, these being heated by the spin block heater 21. The molten filaments leaving the capillaries 33 also heat this air. In this way, the air inside the shroud 26 remains hot at a temperature close to or just below, the temperature of the melt being extruded and prevents substantial cooling of the filaments as they pass therethrough. The temperature in the lower portion of the shroud 26 may be at a lower temperature than in the upper portion, but is sufficiently high to retard cooling of the filaments.

Figure 4:
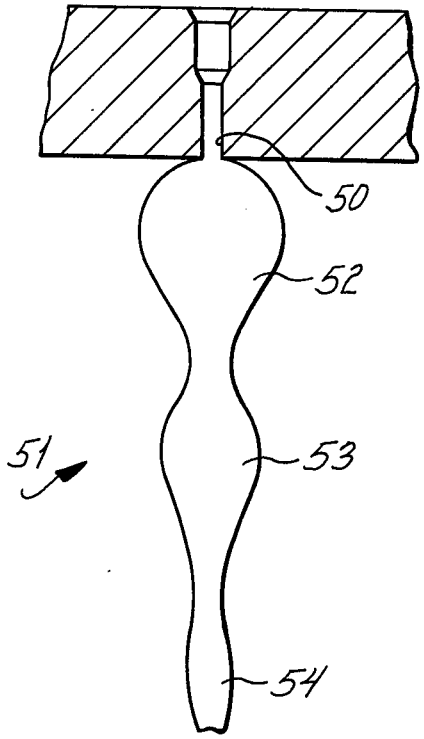
FIG. 4 is an illustration, on an enlarged scale, of a filament being produced.

FIG. 4 shows in an exaggerated manner a polypropylene filament being extruded from a capillary 50 directly into an air quenching zone 51 by a conventional air quench process. The molten polypropylene swells out at 52 under the face of the spinnerette and then forms a series of diminishing swellings 53, 54 before the draw-down to the size of the filament is completed. This series of swellings is not completely drawn out and results in the filament exibiting resonance to some degree.

Figure 5:
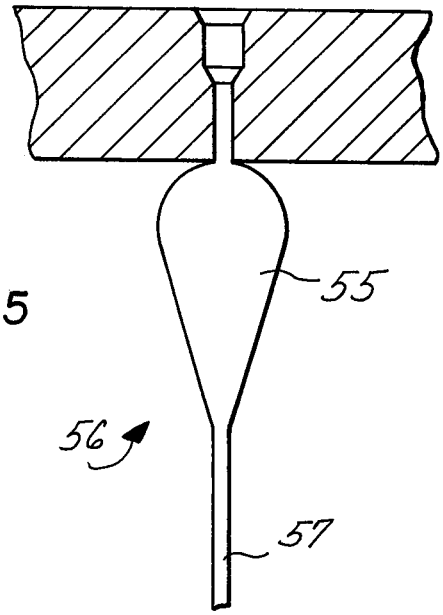
FIG. 5 is an illustration, on an enlarged scale, of another filament being produced uniformly.

FIG. 5 illustrates the way in which the swell draws down in the present invention. An initial swell 55 occurs under the face of the spinnerette, but then due to the combination of the low temperature of extrusion and the extrusion of the filament into a hot quiescent zone 56, the draw down occurs quicker over a shorter distance to a uniform filament 57. As can be seen, the total volume of the swell 55 is less than the volume of the elongated swell 52, 53, 54 shown in FIG. 4.

The 900 undrawn denier 70 filament yarn produced by the method of the invention, when subsequently drawn at a draw ratio of 3:1 to a continuous filament 300 denier 70 filament yarn, produces a uniform yarn with substantially no resonance symptoms and improved uniformily of denier from filament to filament. The yarn also draws with a high efficiency with substantially no draw breaks. This further makes possible multi-end drawing, for example drawing eight yarns together on the same drawframe.

For the production of finer denier per filament yarns it is preferable to use narrow molecular weight distribution polypropylene with a higher melt flow, for example in the range 35 to 45, and with a lower swell value, for example in the range 1.2 to 1.7.

Narrow molecular weight distribution polypropylene is usually made by thermal degradation of reactor resin, although this can be done chemically. The object is to degrade the high molecular weight material. The swell value is the ratio of the diameter of the extrudate just below the face of the spinnerette divided by the diameter of the capillary through which it is being extruded. This should be measured using a capillary with basically zero land (length to radius ratio not greater than 0.221) at a temperature of 190° C. and at a shear rate of one thousandth of a second. Shear rate equals four times the volumetric flow rate (q in cubic centimeters per second) divided by $\pi$ times the third power of the capillary radius (in centimeters) i.e.

$$\text{Shear rate} = \frac{4q}{\pi \times \text{radius}^3}$$

What is claimed is:

1. A method of producing a multifilament polypropylene yarn comprising heating polypropylene having a narrow molecular weight distribution with a swell value of less than 3 to a temperature at which it is molten, extruding the molten polypropylene at a temperature less than 425° F. into a plurality of filaments, passing the filaments through a first zone having a temperature sufficiently high to retard cooling of the filaments therein, drawing down the filaments to their undrawn denier in said first zone, then passing the filaments through a second zone, and directing cooling gas over the filaments in said second zone to cool them, the combination of the swell value of the polypropylene, the temperature of extrusion, and the temperature of said first zone interacting to substantially eliminate the occurance of resonance in the filaments as they are drawn down in said first zone.

2. A method as claimed in claim 1 in which the first zone contains gas at a temperature less than 75° F. below the temperature at which the molten polypropylene is extruded.

3. A method as claimed in claim 1 in which the first zone contains gas at a temperature above 350° F.

4. A method as claimed in claim 1 in which the temperature of said first zone is within 60° F. of the temperature at which said molten polypropylene is extruded.

5. A method as claimed in claim 1 in which said cooling gas is passed through said second zone transversely to the filaments.

6. A method as claimed in claim 5 in which the temperature of said cooling gas as it enters said second zone is less than 90° F.

7. A method as claimed in claim 5 in which said first zone is short relative to said second zone and contains gas in a quiescent state.

8. A method as claimed in claim 1 in which the filaments are drawn down in said first zone to a denier per filament less than 40.

9. A method as claimed in claim 8 in which said denier is less than 30.

10. A method as claimed in claim 1 in which a metered stream of said molten polypropylene is extruded through a spinnerette having at least two groups of orifices to produce from said metered stream at least two yarns each having a plurality of filaments.

11. A method of producing multifilament yarns comprising heating polypropylene having a narrow molecular weight distribution with a swell value less than 2.5 and a melt flow greater than 30 to a temperature in the range 360° F. to 420° F., metering a stream of said heated polyproylene, extruding said metered stream at said temperature downwards through a spinnerette having at least two groups of orifices to produce at least two groups of filaments therefrom, passing said filament downwards through a hot zone containing quiescent air at a temperature sufficiently high to retard cooling of the filaments, passing the filaments through a quenching zone, blowing air through said quenching zone transversily to the filaments to cool them, pulling the multifilament yarns out of said quenching zone at a controlled rate so that said filaments while in said (first) hot zone are drawn down to an undrawn denier per filament less than 40, the characteristics of the polypropylene, the temperature of extrusion and the temperature of said hot zone interacting to substantially eliminate the occurance of resonance in the filaments.

12. A method of producing a uniform polypropylene filament comprising extruding the filament at a temperature less than 425° F. into a relatively short hot zone containing gas at a temperature less than 70° F. below the temperature of extrusion, drawing down said filament to its undrawn denier, and thereafter passing the filament through a quenching zone to cool it, the low temperature of extrusion and the closeness to it of the temperature of the gas in said hot zone interacting in relation to the drawing down of the filament to substantially eliminate the occurance of resonance in the filament.

13. A method of producing a uniform polypropylene filament as claimed in claim 12 in which the temperature of the gas in said hot zone is greater than 350° F.

* * * * *